US005729442A

United States Patent [19]

Frantz

[11] Patent Number: 5,729,442

[45] Date of Patent: Mar. 17, 1998

[54] THERMOSTAT HOUSING WITH REMOVABLE TERMINAL BLOCK

[75] Inventor: Robert Houston Frantz, Newville, Pa.

[73] Assignee: The Whitaker Corporation, Wilmington, Del.

[21] Appl. No.: 656,109

[22] Filed: May 31, 1996

[51] Int. Cl.[6] ..... H01R 9/00; H01R 9/22

[52] U.S. Cl. ..... 361/823; 361/728; 361/736; 361/752; 439/718

[58] Field of Search ..... 361/728, 736, 361/748, 752, 823; 439/552, 557, 709–718

[56] References Cited

U.S. PATENT DOCUMENTS

| | | | |
|---|---|---|---|
| 5,052,950 | 10/1991 | Wilson | 439/709 |
| 5,247,275 | 9/1993 | Buckshaw et al. | 337/329 |
| 5,292,263 | 3/1994 | Mosser et al. | 439/812 |
| 5,431,581 | 7/1995 | Laudereau | 439/341 |
| 5,462,451 | 10/1995 | Yeh | 439/493 |
| 5,485,954 | 1/1996 | Guy et al. | 236/78 R |

*Primary Examiner*—Leo P. Picard
*Assistant Examiner*—Jayprakash N. Gandhi
*Attorney, Agent, or Firm*—Robert Kapalka

[57] ABSTRACT

A thermostat housing which provides a protective enclosure for electronic components of a thermostat assembly comprises a base, a terminal block removably attached to the base, and a cover. The terminal block provides an interface between the electronic components of the thermostat assembly and wires of a building climate control system. The terminal block can be replaced as an individual unit in the event it becomes damaged or defective.

4 Claims, 4 Drawing Sheets

THERMOSTAT HOUSING WITH REMOVABLE TERMINAL BLOCK

FIELD OF THE INVENTION

The invention relates to a thermostat assembly having an electrical interface for mating electronic components of the assembly with wires of a building climate control system.

BACKGROUND OF THE INVENTION

A prior art thermostat assembly includes a circuit board having electronic components thereon, and an electrical connector attached to the circuit board and matable with wires of a climate control system in a building. The electrical connector is permanently attached to the circuit board by soldering. In order to assure that secure and reliable connections can be made with the control system wiring, the electrical connector has terminals with screw actuators which are operable to clinch or clamp the wires to the terminals. The screw actuators enable a high clamping force to be applied to the wires. However, these actuators can be unintentionally overtightened, thereby leading to breakage of the terminal or the connector housing. When this happens the entire circuit board must be replaced, since the connector on the circuit board is not individually removable and replaceable. Replacing the circuit board is costly and may result in a long delay while a new part is obtained. There is a need for a device which overcomes the problem of having to replace the circuit board when the electrical connector is damaged.

SUMMARY OF THE INVENTION

The invention is a thermostat housing which provides a protective enclosure for electronic components of a thermostat assembly. The thermostat housing comprises a base, a terminal block removably attached to the base, the terminal block providing an interface between the electronic components of the thermostat assembly and wires of a building climate control system, and a cover attachable to the base and cooperable with the base to define the enclosure.

The invention also provides an improved thermostat assembly including a base and a cover which cooperate to define an enclosure for a circuit board having electronic components thereon, wherein the improvement comprises a terminal block removably attached to the base, the terminal block providing an interface between the electronic components and wires of a building climate control system.

In a preferred embodiment, the terminal block is removably attached to the base by at least one resilient latch. The base may include an overhanging ledge, and the terminal block may have a lip which is insertable beneath the overhanging ledge.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
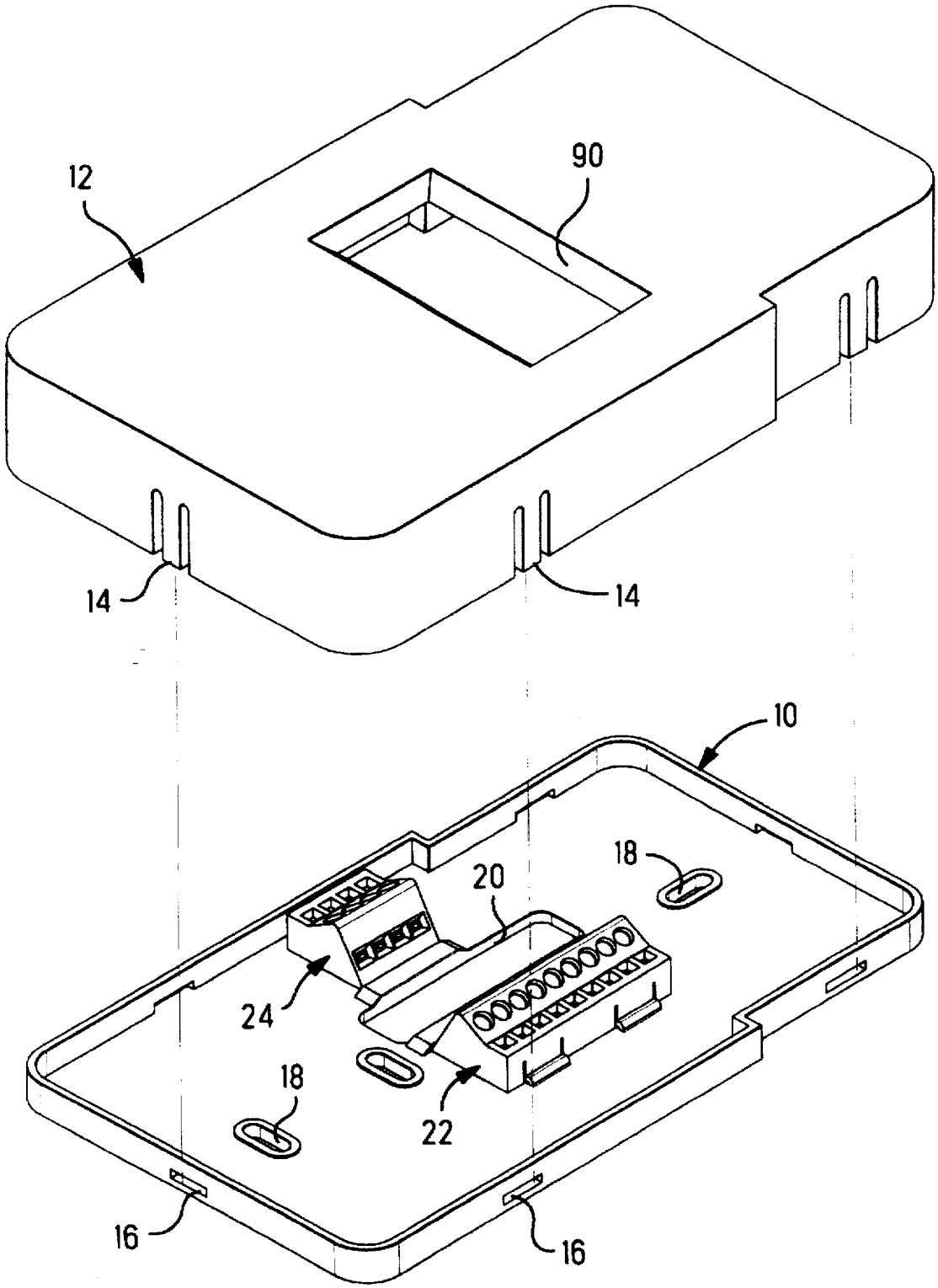
FIG. 1 is an isometric view of a thermostat housing having a cover exploded away.

With reference to FIG. 1, a thermostat housing includes a base 10 and a cover 12 which provide a protective enclosure for the electronic components of a thermostat assembly. The base and the cover are attachable together such as by resilient latches 14 having tabs 15, shown in FIG. 4, which are engageable in slots 16. The base 10 has several elongated holes 18 through which mounting screws can be inserted for fastening the base to a wall of a building. An aperture 20 in the base permits wiring from a building climate control system to be introduced into the thermostat housing for connection to the electronic components therein.

Figure 2:
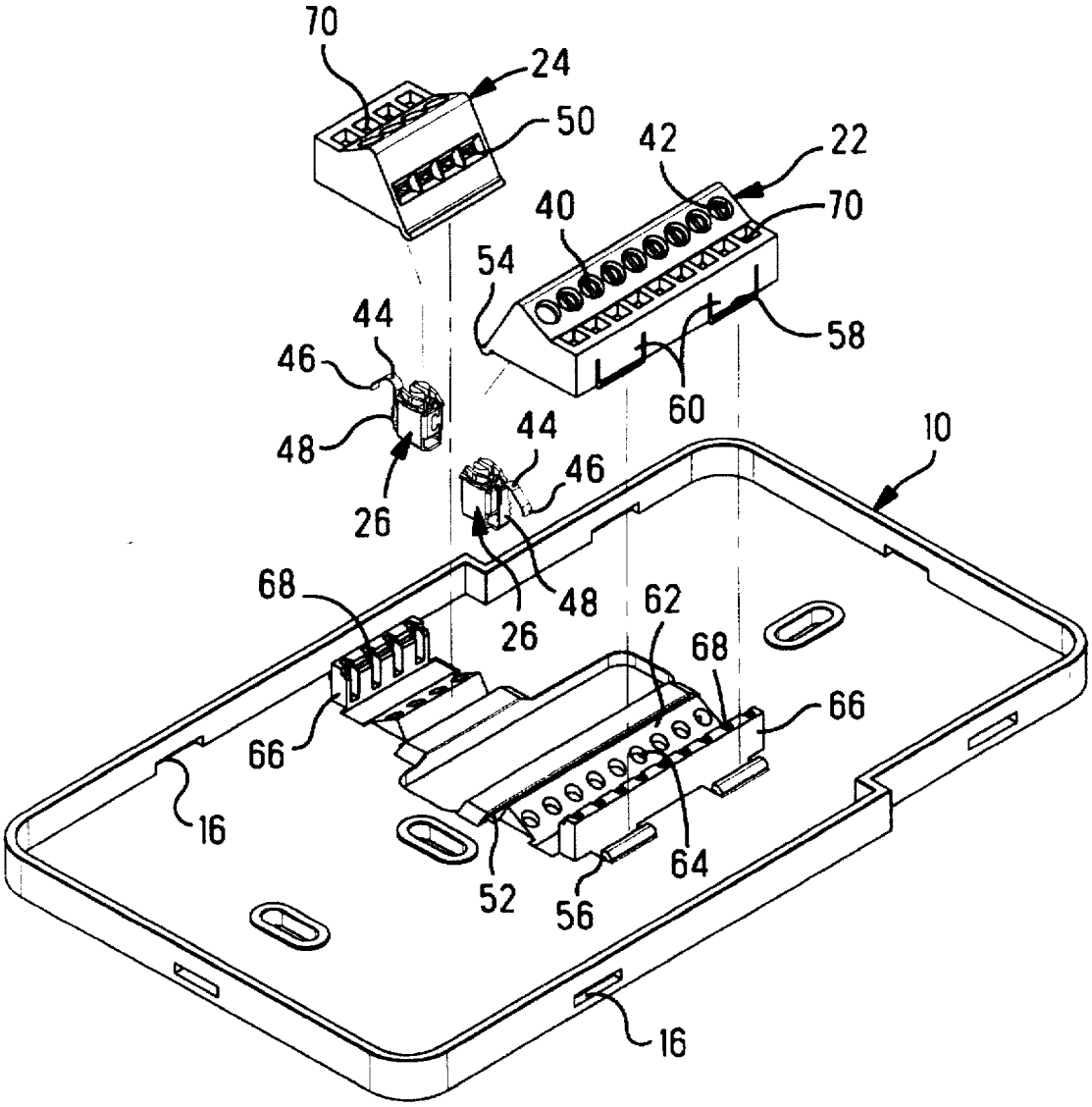
FIG. 2 is an isometric view of the thermostat housing without the cover and having terminal blocks and terminals exploded away.

Referring now to FIG. 2, one or more terminal blocks 22,24 are removably attachable to the base 10. The terminal blocks 22,24 provide a separable interface between the climate control system wiring and the thermostat electronic components. Each of the terminal blocks 22,24 carries a number of terminals 26 which are preferably of a type described in U.S. Pat. No. 5,292,263 which is incorporated by reference as if set forth fully herein. The terminal blocks 22,24 are nearly identical, although each carries a different number of the terminals 26. For convenience, only the terminal block 22 and its attachment to the base 10 will be described in detail, while like reference numbers will be used to identify like elements associated with the terminal block 24.

The terminal block 22 includes a dielectric housing with an open bottom which permits insertion of the terminals 26 into respective cavities in the housing. The terminals are retained in the housing by barbs 48 on an electrically conductive portion 44 which engage in walls of a slot in the housing.

Figure 3:
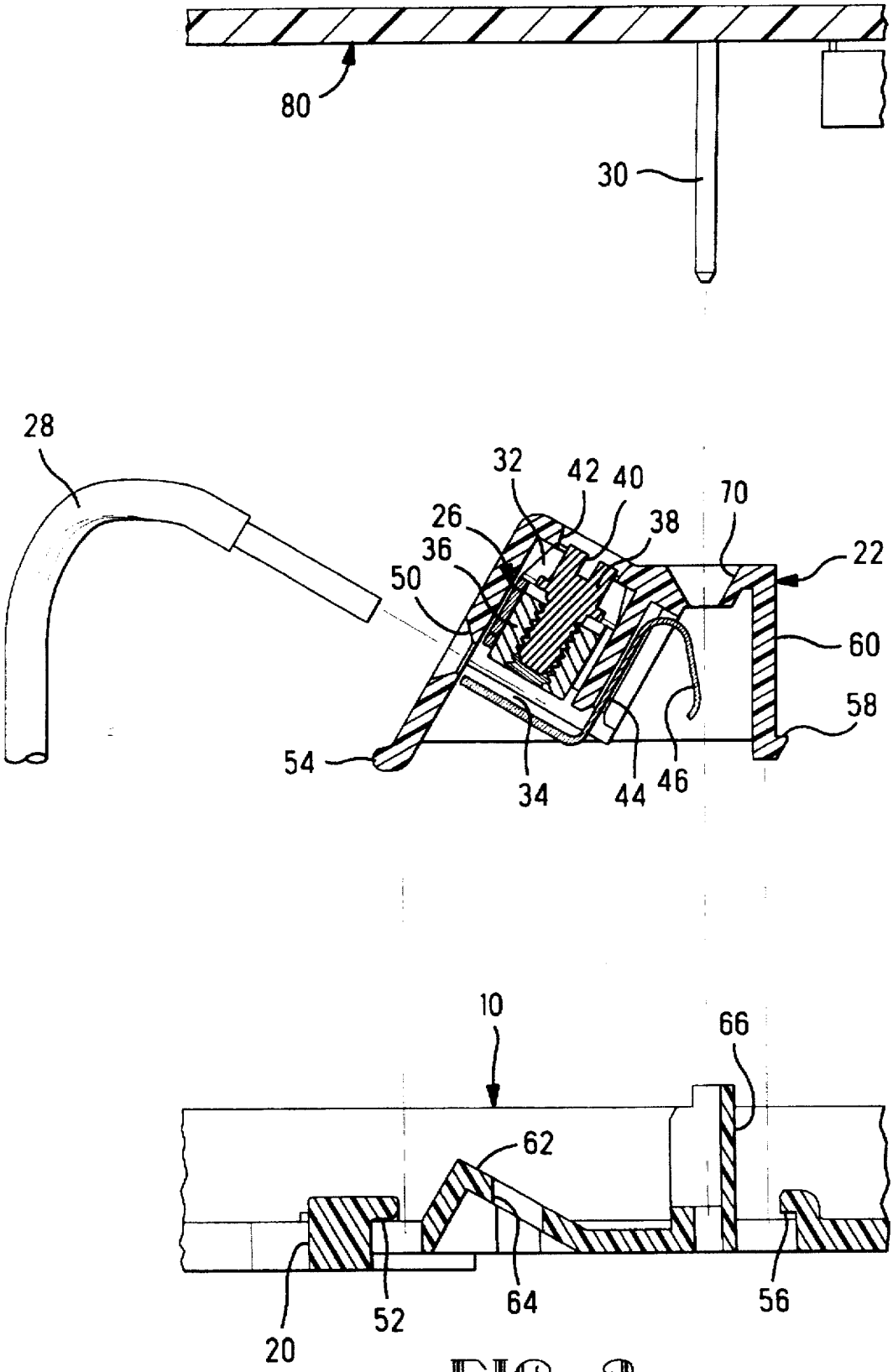
FIG. 3 is an enlarged cross-sectional exploded view of a portion of a thermostat assembly.
Figure 4:
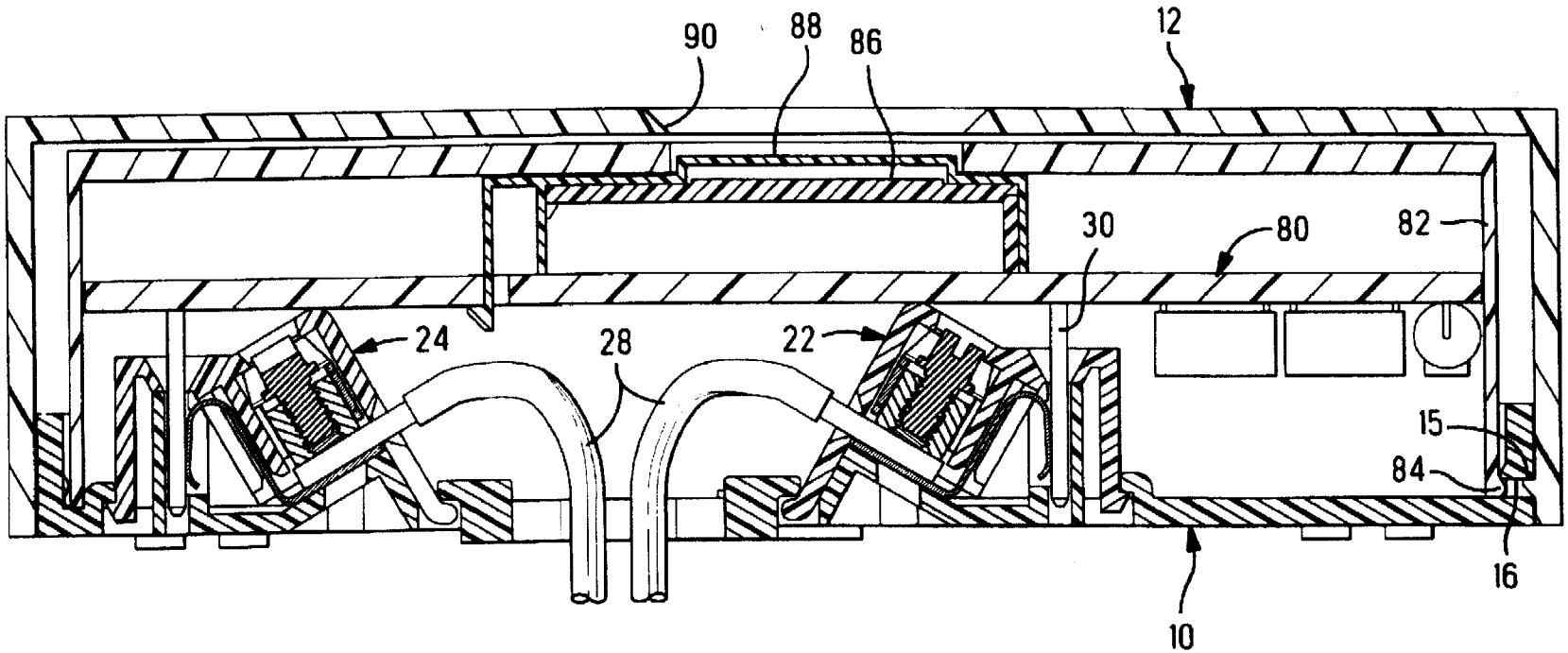
FIG. 4 is a cross-sectional view through an assembled thermostat assembly.

With reference to FIGS. 2–4, the base 10 has an upraised portion with an overhanging ledge 52, and the terminal block 22 has a lip 54 which is insertable beneath the ledge. The base 10 further has a pair of upraised portions each with a catch 56, and these are engageable by respective hook portions 58 of resilient latch arms 60 extending from the terminal block. The resilient latch arms 60 provide a means for removably attaching the terminal block 22 to the base 10.

A wire 28 of the climate control system passes through the aperture 20 in the base 10 and through a hole 50 in the terminal block 22 for mating with one of the terminals 26. Each of the terminals 26 includes a cage 32 which defines a reception zone 34 for the wire 28. A clamp 36 is movably mounted in the cage 32 for clamping the wire 28 in the reception zone. A clamp screw 38 is rotatably mounted in the cage 32 and is threaded in the clamp 36 so that rotation of the screw 38 moves the clamp 36 toward and away from the reception zone 34. The screw 38 has a head with a slot 40 which is accessible through a hole 42 in the terminal block, whereby the screw 38 can be rotated with a screwdriver to secure or release the wire 28. When the wire 28 is secured in the reception zone it is urged against the electrically conductive portion 44 of the terminal.

The base 10 has an inclined seat 62 which substantially closes off the terminal receiving cavities of the terminal block when the terminal block is attached to the base. Apertures 64 in the seat which are aligned with each of the terminals in the terminal block 22 permit insertion of an electrical test probe into the thermostat housing after it has been assembled.

A wall 66 which stands upward from the base 10 is covered by the terminal block 22 when the terminal block is attached to the base. The wall 66 has a series of cavities 68 which extend into the wall 66 through a top and side thereof. The conductive portion 44 of each of the terminals 26 has a resilient end portion 46 which extends into one of the cavities 68 through the side of the wall 66. The terminal block 22 has a series of openings 70 which are in registration with the cavities 68 through the top of the wall 66 when the terminal block is attached to the base.

The thermostat housing is adapted to receive a circuit board 80 on which are mounted electronic control elements for a thermostat assembly. The circuit board carries a series of header posts 30, only one of which is shown in the cross-sectional views of FIGS. 3 and 4. Each of the posts 30 is insertable through one of the holes 70 into one of the cavities 68 where it engages and deflects the end portion 46 of one of the terminals 26. Thus, the wire 28 and the header post 30 are electrically connected through the conductive portion 44.

In a thermostat assembly as shown in FIG. 4, the circuit board 80 is attached to a stand 82 which is supported on the base 10 and secured thereto such as by latch tabs 84 which snap into the slots 16 from an interior of the housing and opposite to the tabs 15 of the cover 12. A display panel 86 is mounted on the circuit board 80 beneath a clear plastic window 88. The display panel 86 is viewable through a window 90 in the thermostat cover 12.

The invention provides a thermostat housing having a removably attached terminal block. The invention has the advantage that a damaged or defective terminal block can be individually replaced, thereby avoiding replacement of an entire circuit board assembly. The thermostat housing has a snap together design which makes replacement of the terminal block a relatively simple operation.

The invention having been disclosed, a number of variations will now become apparent to those skilled in the art. Whereas the invention is intended to encompass the foregoing preferred embodiments as well as a reasonable range of equivalents, reference should be made to the foregoing discussion of examples in order to assess the scope of the invention in which exclusive rights are claimed.

I claim:

1. A thermostat housing which provides a protective enclosure for electronic components of a thermostat assembly, the thermostat housing comprising:

a base;

a terminal block removably attached to the base, the terminal block having terminals each including a cage which defines a wire reception zone for a respective wire of a building climate control system, a clamp which is movably mounted for clamping the respective wire in the wire reception zone, and an arm which is electrically connected to the respective wire when the respective wire is clamped in the wire reception zone, the terminal block having apertures each in registration with a respective said arm;

a circuit board having the electronic components mounted thereon, and header posts which are electrically joined to the electronic components, each of the header posts being received in a respective said aperture and engaged with a respective said arm, wherein the terminal block provides an interface between the electronic components and the wires of the building climate control system; and a cover attachable to the base and cooperable with the base to define the enclosure.

2. The thermostat housing according to claim 1, wherein the terminal block is removably attached to the base by at least one resilient latch.

3. The thermostat housing according to claim 2, wherein the base includes an overhanging ledge, and the terminal block has a lip which is insertable beneath the overhanging ledge.

4. The thermostat housing according to claim 1, wherein each of the terminals further includes a clamp screw which is operably mounted for moving the clamp toward and away from the wire reception zone.

* * * * *